US007958646B2

(12) United States Patent
So

(10) Patent No.: US 7,958,646 B2
(45) Date of Patent: Jun. 14, 2011

(54) SLIP RESISTANT RULER

(75) Inventor: Kuen Leung So, Hong Kong (HK)

(73) Assignee: Captronics Industrial Ltd., Hong Kong (HK)

( * ) Notice: Subject to any disclaimer, the term of this patent is extended or adjusted under 35 U.S.C. 154(b) by 0 days.

(21) Appl. No.: 12/830,438

(22) Filed: Jul. 6, 2010

(65) Prior Publication Data

US 2011/0088270 A1 Apr. 21, 2011

(30) Foreign Application Priority Data

Oct. 15, 2009 (CN) ..... 2009 2 0237296 U

(51) Int. Cl.
*B43L 7/00* (2006.01)

(52) U.S. Cl. ..... 33/484; 33/485; 33/562

(58) Field of Classification Search ..... 33/483–485, 33/489, 494, 666, 669, 562, 566, 11, 18.1, 33/32.1, 32.2, 32.3, 403, 430
See application file for complete search history.

(56) References Cited

U.S. PATENT DOCUMENTS

| | | | | |
|---|---|---|---|---|
| 5,471,749 | A * | 12/1995 | Brady | 33/484 |
| 5,615,488 | A * | 4/1997 | Brady | 33/484 |
| 6,314,653 | B1 * | 11/2001 | Iso | 33/484 |
| 7,043,850 | B2 * | 5/2006 | Brady | 33/562 |
| 7,191,534 | B2 * | 3/2007 | Szumer et al. | 33/484 |
| 7,484,304 | B2 * | 2/2009 | Campagna et al. | 33/286 |
| 7,509,745 | B2 * | 3/2009 | Schafer et al. | 33/1 B |
| 2007/0175052 | A1 * | 8/2007 | Schafer et al. | 33/1 B |

* cited by examiner

*Primary Examiner* — Yaritza Guadalupe-McCall
(74) *Attorney, Agent, or Firm* — Law Offices of Thomas E. Schatzel, A Prof. Corp.

(57) ABSTRACT

A ruler including a slip resistant member, wherein the slip resistant member is operable to engage with a working surface to resist the sliding of the ruler when user applies force on the slip resistant member, and is disengaged from the working surface to allow the sliding of the ruler on the working surface when user releases force applied on the slip resistant member.

4 Claims, 8 Drawing Sheets

SLIP RESISTANT RULER

FIELD OF PATENT APPLICATION

The present patent application relates generally to stationery and, in particular, a ruler which provides friction against the working surface.

BACKGROUND

A slip resistant ruler prevents the ruler from moving when the user is drawing a line or cutting paper with a cutter against the edge of the ruler. It is particularly handy when the working table has a tilted surface.

There is existing slip resistant ruler which provides a slip resistant surface on the bottom of the ruler. The disadvantage of such a ruler is that the slip resistant surface of the ruler may make it difficult for the user to slide the ruler on the paper after use, for example to another position for drawing. Because of the friction between the slip resistant surface and the paper, the whole paper may be moved when the user tries to slide the ruler on the paper.

Another disadvantage is that as the user tends to press at the middle part of the ruler to keep it in position, the force applied by the user on the ruler is not evenly spread along the whole ruler. As a result, the end of the ruler tends to move when the user is drawing or cutting the paper near the end of the ruler.

SUMMARY

The object of the present patent application is to provide an improved slip resistant ruler which overcomes one or more of the disadvantages discussed above.

The ruler of this patent application includes a slip resistant member, wherein the slip resistant member is operable to engage with a working surface to resist the sliding of the ruler when user applies force on the slip resistant member, and is disengaged from the working surface to allow the sliding of the ruler on the working surface when user releases force applied on the slip resistant member.

Preferably, the slip resistant member is arranged to distribute engaging force along the slip resistant member on the working surface.

Preferably, the slip resistant member includes a biasing device for biasing the slip resistant member against the working surface when the slip resistant member is engaged with the working surface.

Preferably, the slip resistant member includes a biasing device for biasing the slip resistant member to disengage from the working surface when user releases force applied on the slip resistant member.

In an embodiment of this patent application, the ruler includes a main body, an open portion in the main body, an actuating body disposed in the open portion, and a slip resistant surface disposed on the actuating body operable between a retreated position and an exposed position. The actuating body operates the slip resistant surface to expose from the open portion to engage with the working surface in the exposed position.

In another embodiment of this patent application, the ruler further includes a biasing device for biasing the slip resistant surface to engage with the working surface in the exposed position when user applies force on the actuating body.

In yet another embodiment of this patent application, the ruler further includes a biasing device for biasing the slip resistant surface to disengage from the working surface when user releases the force applied on the actuating body.

The ruler of this patent application contains a slip resistant surface operable between a retreated position where the slip resistant surface is detached from the working surface and an exposed position where the slip resistant surface is engaged with the working surface. In the retreated position, the user may slide the ruler on the working surface without encountering friction between the slip resistant surface and the working surface.

BRIEF DESCRIPTION OF DRAWINGS

The above and other aspects, features, and advantages of the present patent application will become more apparent upon consideration of the following detailed description of preferred embodiments, taken in conjunction with the accompanying drawing figures, wherein:—

DETAILED DESCRIPTION

Figure 1:
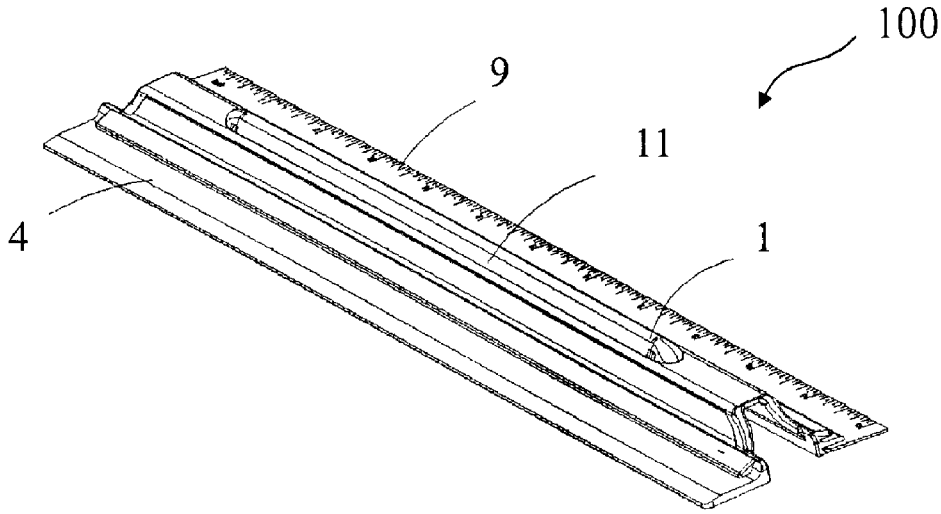
FIG. 1 is a perspective view according to an embodiment of this patent application.
Figure 2:
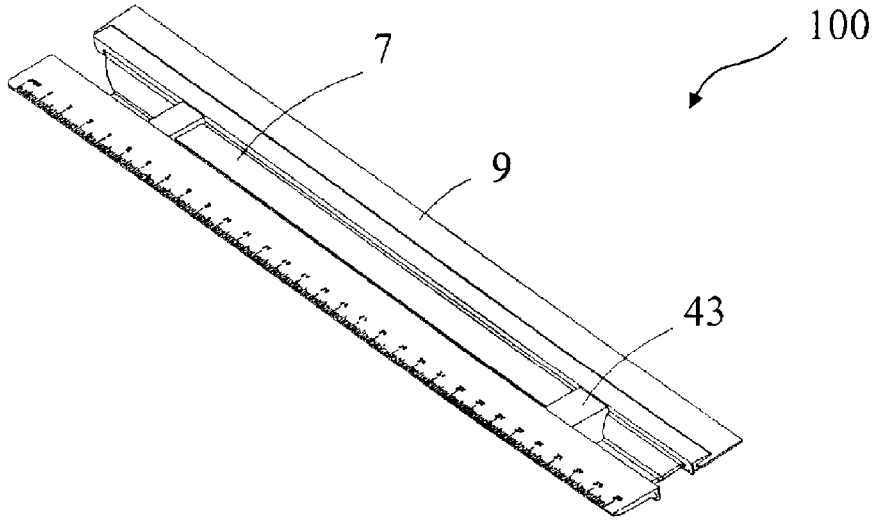
FIG. 2 is a perspective bottom view of the ruler of FIG. 1.
Figure 3:
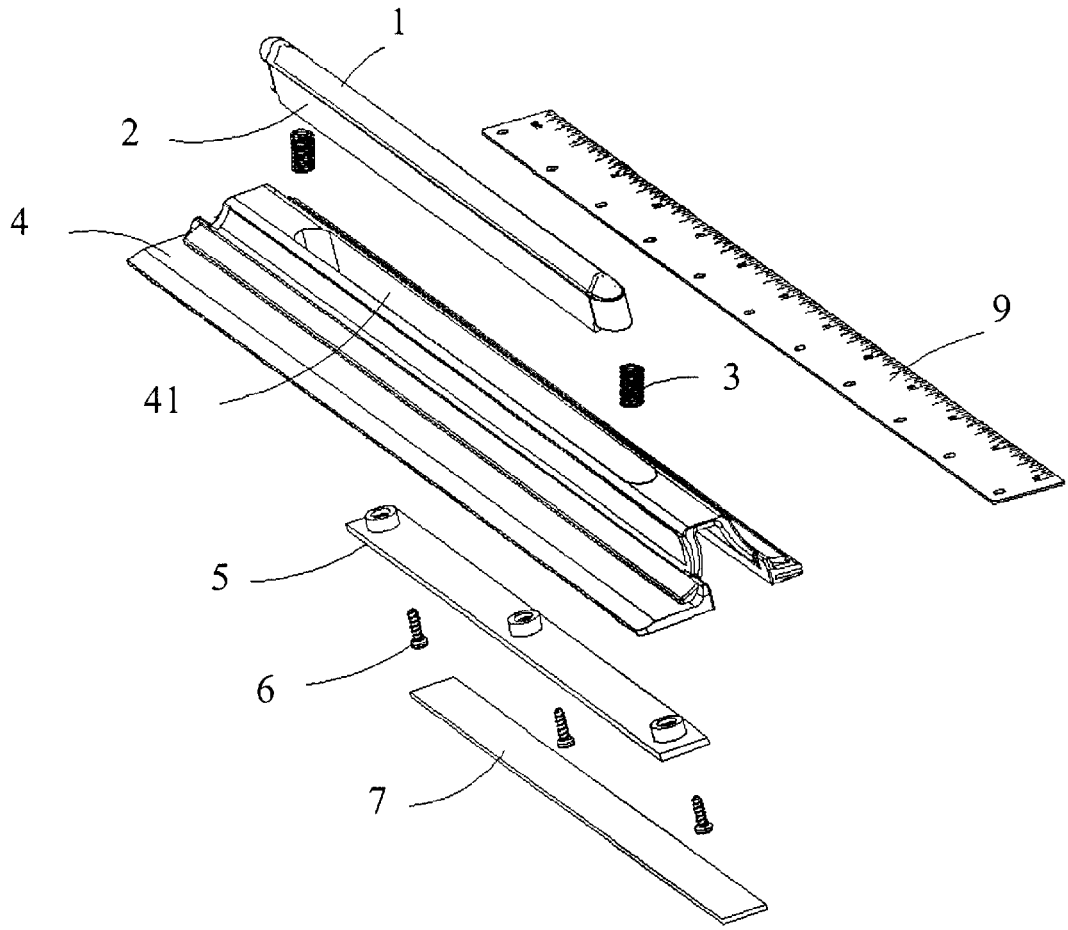
FIG. 3 is a assembly view of the ruler of FIG. 1.

As illustrated in FIG. 1-3, a ruler 100 includes a main body 4 with an open portion 41 for receiving an actuating body 1. In this embodiment, the main body 4 is a long body with markings on the one side for measurement. The markings may form on the edge of the main body 4, or form on a separate measuring portion 9 to be attached to the main body. The main body 4 may be of other shapes according to the function of the ruler.

The middle portion of the main body 4 is raised with a long and narrow opening to form the open portion 41. The actuating body 11 is of the size and shape corresponding to that of the open portion 41 for disposing therein. The open portion 41 and the actuating body 11 are not restricted to any specific shape. The actuating body 1 includes a cap 1 and a base 5 attached thereon by screws 6 or by other means. A slip resistant surface 7 is attached to the bottom of the base 5. In this embodiment, the actuating body 11 and the slip resistant surface 7 may be referred as the slip resistant member.

A biasing device 3 is disposed at the two end portions 2 of the actuating body 11. The slip resistant surface 7 may contain grooves or hollow for increasing the friction. The slip resistant surface 7 may be made of Thermoplastic elastomer (TPE) or rubber or other materials which may increase friction.

Figure 4:
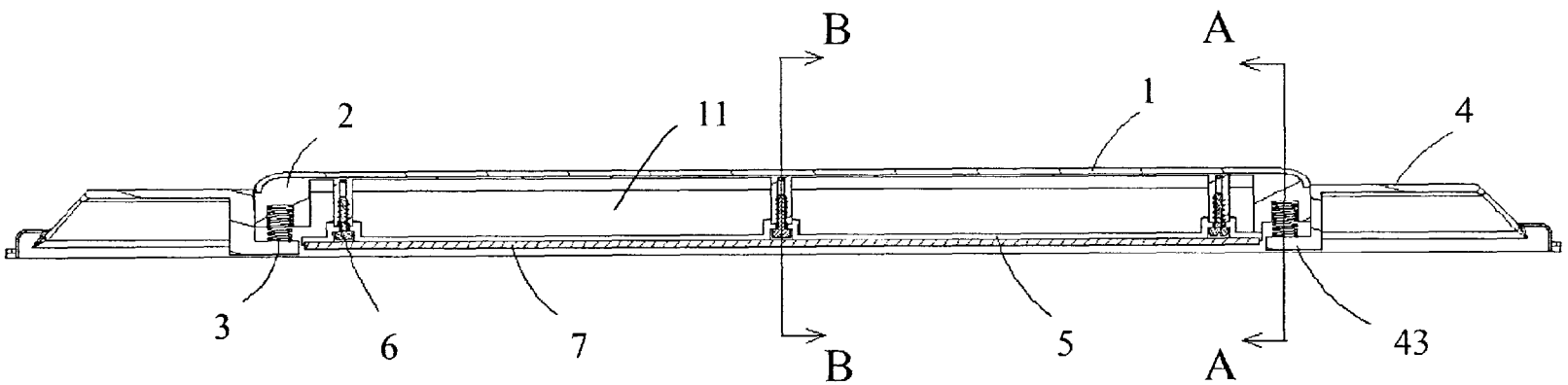
FIG. 4 is a cross sectional view of the ruler of FIG. 1 in the retreated position of the slip resistant surface.
Figure 5:
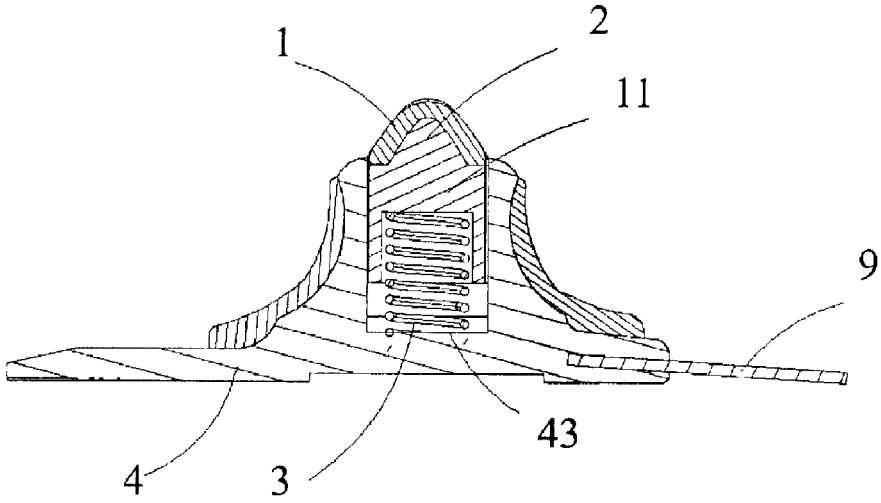
FIG. 5 is a cross sectional view of the ruler of FIG. 4 taken along line A-A.
Figure 6:
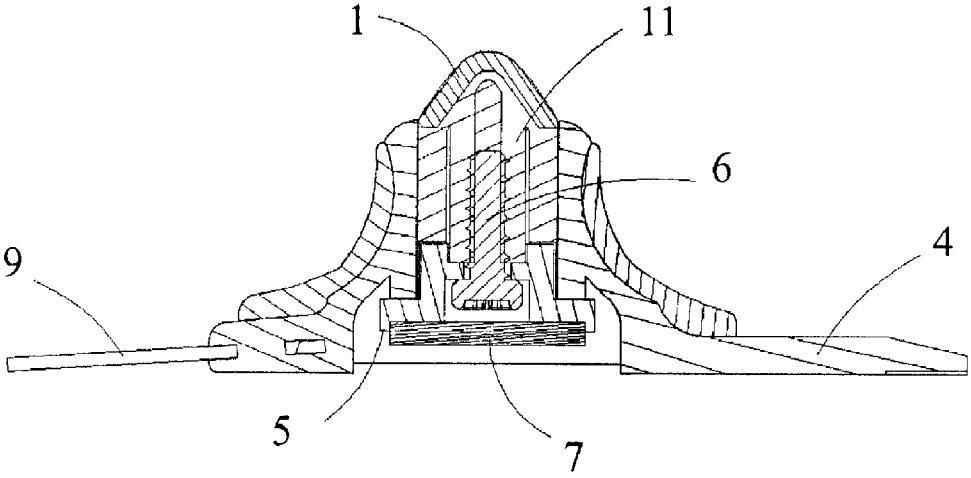
FIG. 6 is a cross sectional view of the ruler of FIG. 4 taken along line B-B.
Figure 7:
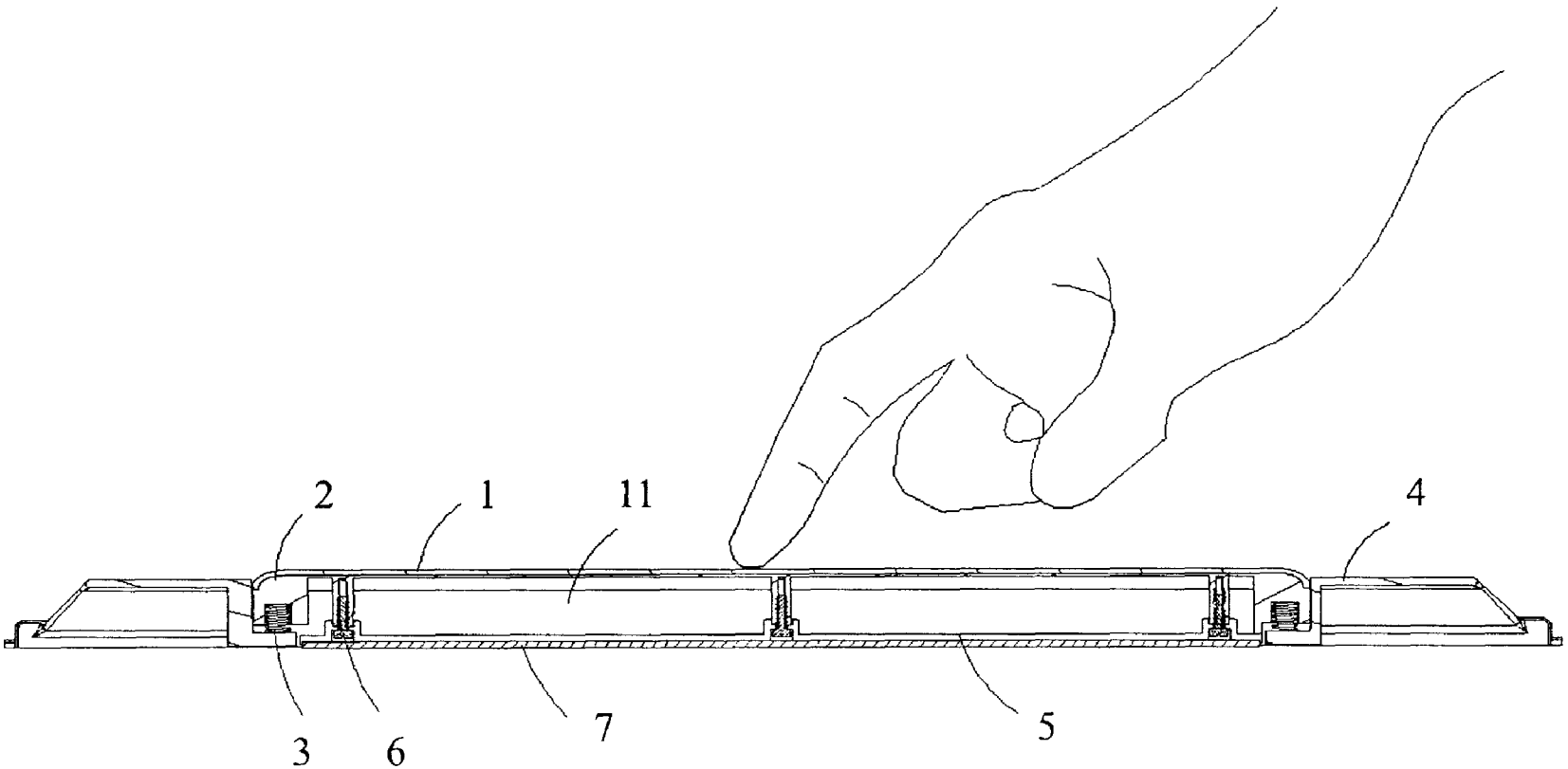
FIG. 7 is a cross sectional view of the ruler of FIG. 1 in the exposed position of the slip resistant surface.
Figure 8:
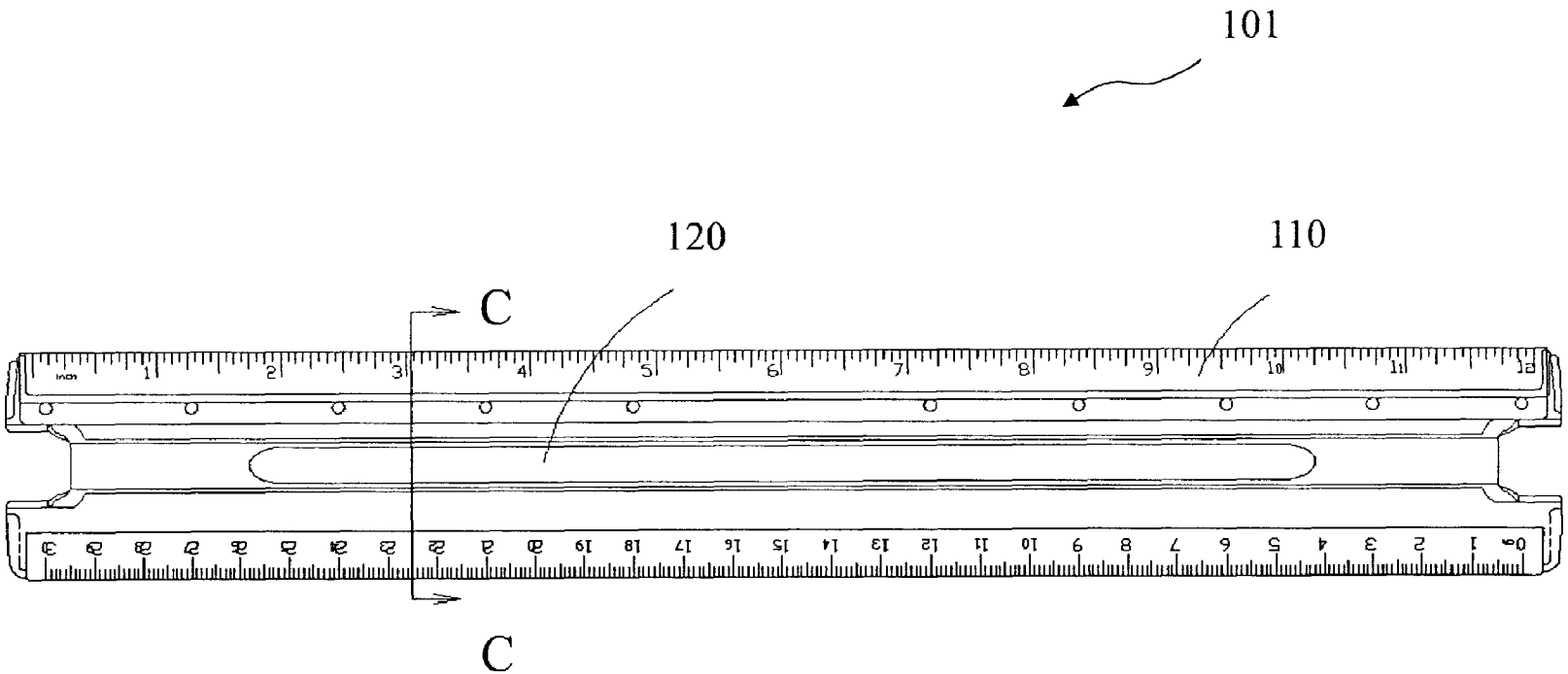
FIG. 8 is a top view according to an embodiment of this patent application.
Figure 9:
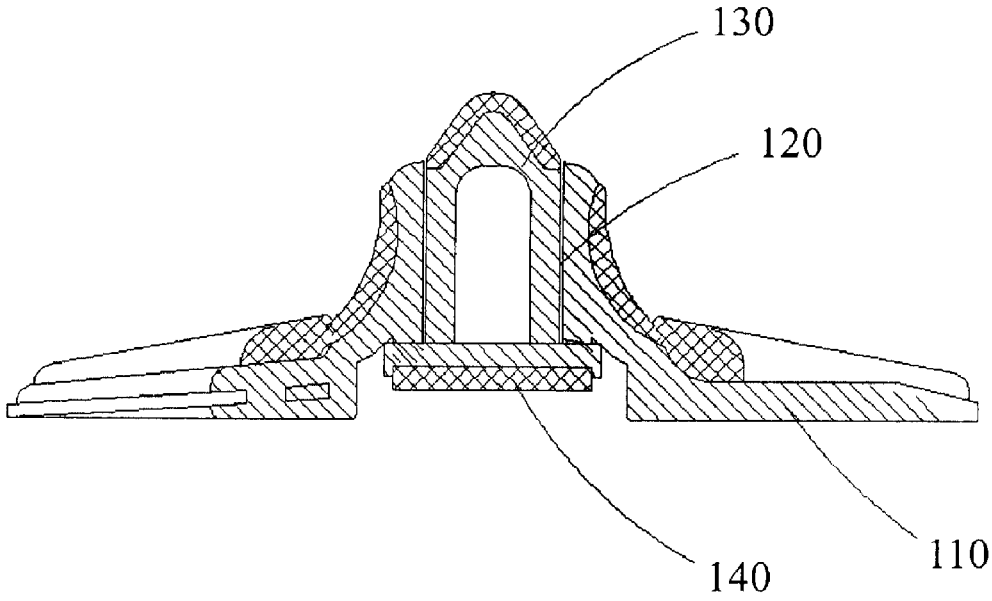
FIG. 9 is the cross sectional view of the ruler of FIG. 8 taken along line C-C.

The actuating body 11 is operable between a retreated position as shown in FIG. 4 and an exposed position as shown in FIG. 7. As shown in FIG. 4, in the retreated position, the biasing device 3 biases the cap 1 to rise above the main body 4 to make it easier for the user to press on the cap. At the same time, as the base 5 is attached with the cap, the resistant surface 7 is retreated in the open portion 41 so that it is not in contact with and is disengaged from the working surface. The ruler 100 is free to slide along on the working surface.

As shown in FIG. 7, in the exposed position, the user applies force on the actuating body 11 by pressing on the cap 1 and causes the slip resistant surface 7 to expose from the open portion 41 to be in contact with the working surface. In this position, the slip resistant surface 7 will engage and interact with the working surface and create a frictional force to prevent the ruler 100 from sliding on the working surface.

In the exposed position, the biasing device 3 is compressed when the user presses the actuating body 11 against the working surface. In this embodiment, the biasing device 3 is disposed between a stand 43 provided on the main body 4 and the actuating body 11. As the cap 1 is kept being pressed by the user against the working surface, the biasing force against the cap 1 will be transmitted to act on the slip resistant surface 7 against the working surface from the end portions 2 of the actuating body. As a result, the biasing device 3 provides biasing force to assist in keeping the slip resistant surface 7 in the exposed position against the working surface, and increases the frictional force there between. In use, the fingers of the user will usually press on the middle part of the cap 1 rather than through out the whole length of the cap. As the biasing device 3 is positioned near the end of the ruler 100, it provides extra force to hold the ruler in place near the end, so that even the user is drawing or cutting paper near the end of the ruler, the ruler can still be held in position. The actuating body 11 therefore distributes the force applied by the user against the working surface engaged with the actuating body and the slip resistant surface 7 along the actuating body. The biasing device 3 may also be positioned at different locations in the actuating body 11. It is also preferable to evenly arrange the biasing device 3 in the actuating body 11 so that the force can be evenly applied on the working surface.

In the retreated position when the user releases the force on the actuating body 11, the biasing device 3 biases the slip resistant surface 7 to disengage and detach from the working surface and return to the retreated position. The ruler 100 is free to be slid to another position on the working surface. The biasing device 3 may be a spring or other biasing device which serves a similar purpose.

As shown in FIGS. 8-11, in another embodiment, the ruler 101 includes a main body 110 with an open portion 120. An actuating body 130 is disposed in the open portion 120. A slip resistant surface 140 is attached to the bottom of the actuating body 130. The actuating body 130 has a resilient portion 135 and the slip resistant surface 140 is made of a resilient material. The resilient portion 135 and the slip resistant surface 140 by way of non-limiting example, may be made of Thermoplastic elastomer (TPE) or rubber or other resilient materials.

Figure 10:
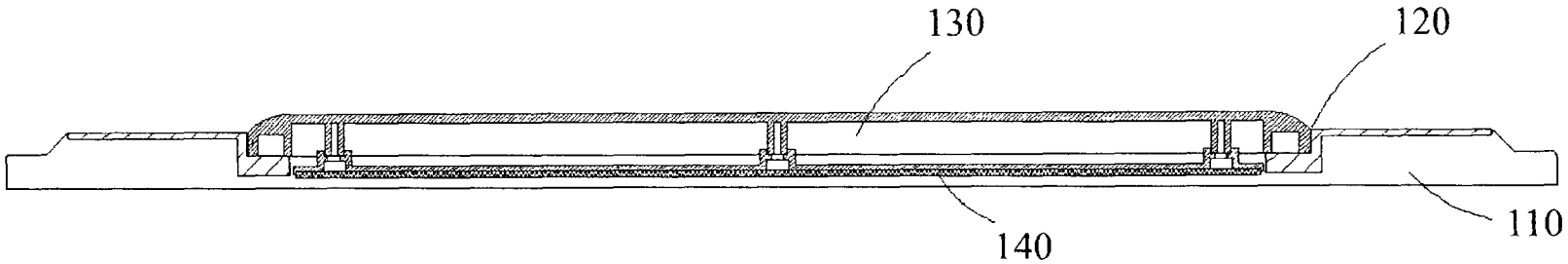
FIG. 10 is the cross sectional view of the ruler of FIG. 8 in the retreated position of the slip resistant surface.
Figure 11:
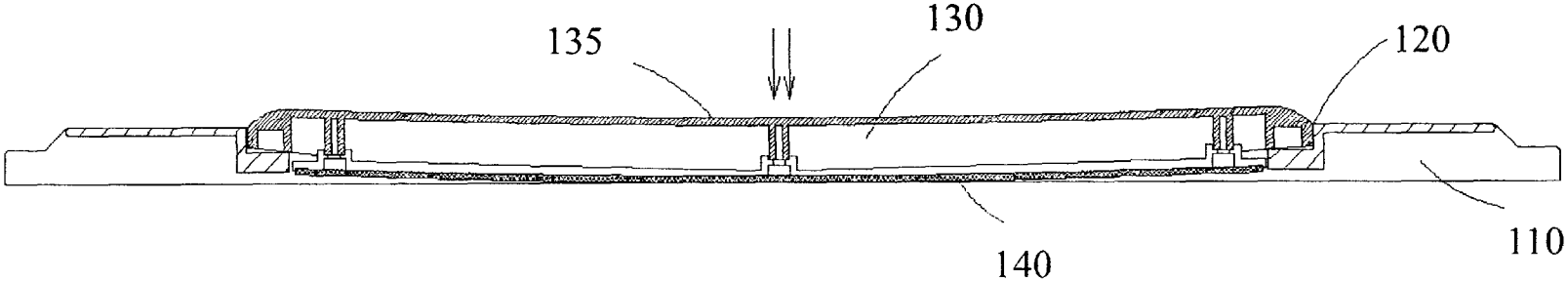
FIG. 11 is the cross sectional view of the ruler of FIG. 8 in the exposed position of the slip resistant surface.

As shown in FIG. 11, when the user applies force on the actuating body 130, the actuating body 130 is bended downward to expose the slip resistant surface 140 from the open portion 120 from the retreated position to the exposed position. When the user releases his force from the actuating body 130, the slip resistant surface 140 will be returned to the retreated position as shown in FIG. 10 due to the resilient nature of the resilient portion 135 and the slip resistant surface 140.

While the patent application has been described in detail with reference to disclosed embodiments, various modifications within the scope of the patent application will be apparent to those of ordinary skill in this field. It is to be appreciated that features described with respect to one embodiment typically may be applied to other embodiments.

What is claimed is:

1. An improved ruler (100, 101) comprising an elongated main body (4, 110) with a measuring edge (9, 101) and a plunging, retractable actuator (11, 130) that can be sequenced between slip and do-not-slip states;

the improvement comprising:

a single linear slot opening (41) centrally disposed in the elongated main body (4) and open above and below;

a single elongation of plunging, retractable actuator (1, 130) and having respective opposite ends (2) that fit inside the linear slot opening (41) and that is configured to be able to move up-and-down within but not side-to-side when operating the ruler between slip and do-not-slip positions;

a linear, continuous non-slip working surface contact (7, 140) attached underneath the retractable actuator (11) inside the elongated main body (4);

a linear cap (1) disposed along the top and the length of the plunging, retractable actuator (11), and providing for user access; and a number of springs (3, 135) disposed in the retractable actuator (11, 130) such that a user's downward pressing force is distributed evenly on the non-slip working surface contact (7, 140) across a working surface.

2. The ruler of claim 1, further comprising:

a set of grooves and hollows disposed in the working surface side of the non-slip working surface contact (7) for increasing its contact friction with any work.

3. The ruler of claim 1, further comprising:

at least one of a rubber material, thermoplastic elastomer (TPE), and resilient substance linearly disposed along the entire working surface side of the non-slip working surface contact (7) for increasing its contact friction with a work surface.

4. The ruler of claim 1, wherein:

the springs (3) are positioned near the ends of the ruler (100) to provide extra force to hold the ruler in place near the ends as said actuator (11) distributes the force applied.

* * * * *